United States Patent [19]

Gassmann

[11] Patent Number: 4,986,014

[45] Date of Patent: Jan. 22, 1991

[54] MATRIX-TYPE ADVERTISING DEVICE

[75] Inventor: Gerhard-Gunter Gassmann, Neuweiler, Fed. Rep. of Germany

[73] Assignee: Gassmann GmbH, Fed. Rep. of Germany

[21] Appl. No.: 308,317

[22] Filed: Feb. 8, 1989

[30] Foreign Application Priority Data

Feb. 8, 1988 [DE] Fed. Rep. of Germany ..... 3803715

[51] Int. Cl.[5] ..... G09F 11/12

[52] U.S. Cl. ..... 40/472; 340/764; 340/815.27; 40/447

[58] Field of Search ..... 40/472, 446, 447, 450, 40/451, 452; 340/764, 783, 755, 815.04, 815.27

[56] References Cited

U.S. PATENT DOCUMENTS

| | | | |
|---|---|---|---|
| 3,600,834 | 8/1971 | Stamer | 40/472 |
| 3,605,302 | 9/1971 | Muller | 40/472 |
| 4,110,922 | 9/1978 | Leeman-Dittmann | 40/447 |
| 4,533,912 | 8/1985 | Gal et al. | 340/764 |
| 4,733,487 | 3/1988 | Gassman | 40/472 |

FOREIGN PATENT DOCUMENTS 3620543 9/1988 Fed. Rep. of Germany .

*Primary Examiner*—Kenneth J. Dorner

*Assistant Examiner*—J. Hakomaki

*Attorney, Agent, or Firm*—Thomas W. Speckman; Douglas H. Pauley

[57] ABSTRACT

A matrix-type advertising device having a circulating transport band with flap-like advertising elements, positioned in rows and columns, which are connected with the transport band on one side in the direction of transport. Dividing strips are positioned in an advertising area, coordinated with the individual rows which have a color contrasting to the transport band provided with the advertising element. The advertising elements in front of or behind the coordinated dividing strips can be brought into the advertising position. In one previously known advertising device of a similar type, the dividing strips are rigidly constructed and accommodated in and fixedly attached to a casing. The advertising device, in the case of a large advertising field, is thus correspondingly large and heavy. In order to make an efficient and spacesaving matrix-type advertising device transportable and usable, even with a large surface advertisement, this invention provides that the dividing strips are constructed as flexible bands and the flap-like advertising elements are positioned against one another so that the edges of the dividing strips, in the direction of transport, are guided and supported by the transport band.

22 Claims, 5 Drawing Sheets

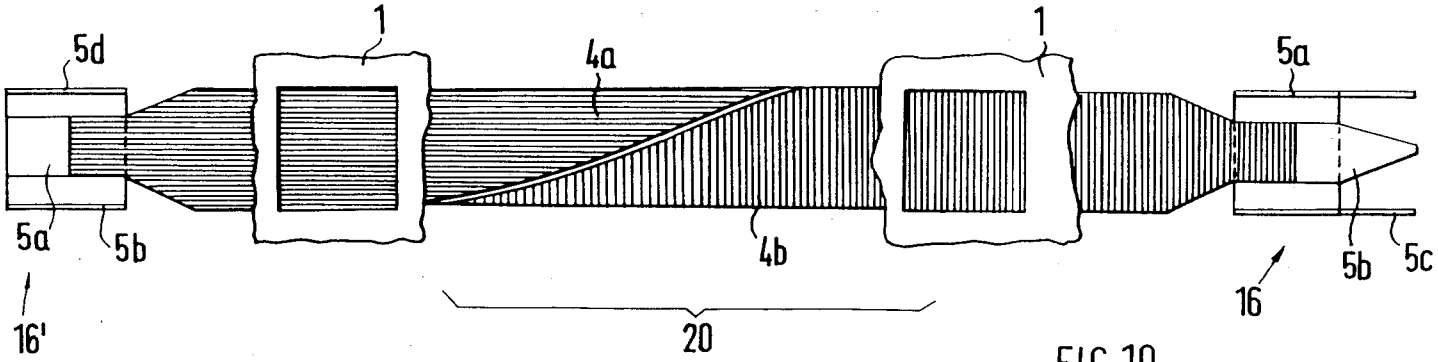
FIG. 10
FIG. 11
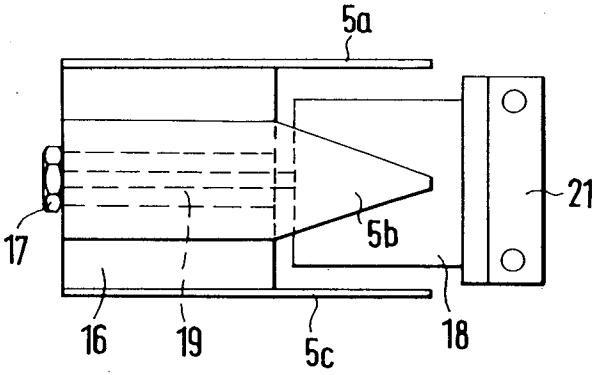

MATRIX-TYPE ADVERTISING DEVICE

BACKGROUND OF THE INVENTION

1. Field of the Invention

This invention relates to a matrix-type advertising device with a circulating transport unit having flap-like advertising elements which are connected with a transport band on one side and which can be brought into an advertising position.

2. Description of the Prior Art

One known type of advertising device is described in German patent application DE No. 36 20 543 C2. The dividing strips are rigidly constructed and are accommodated within and secured to a housing. Such known advertising device is, in the case of a large advertising field, large and heavy.

SUMMARY OF THE INVENTION

It is one object of this invention to further develop a matrix-type advertising device of the type stated above so that the device can be transported while saving space and can be produced at lower costs, even with a large-surface advertisement. Furthermore, horizontal dividing strip tolerances can be adjusted to the transport band.

According to one embodiment of this invention, the dividing strips are constructed as flexible bands and the foldable advertising elements are positioned against one another so that the edges of the flexible dividing strips proceeding in the direction of transport are guided and supported by the transport band.

In one embodiment, the advertising device positioned between two transport rollers is so flexible that it can be transported while efficiently saving space. Where installed, the transport rollers need only be set up at correct distances, then the advertising device is ready for use. In this embodiment, a placing device is placed at least in the area of one transport roller. The transport band can be designed as a band section or a band loop. The advertising device can be designed for a single-side advertisement as well as for a double-sided advertisement. In the case of a double-sided advertisement, the dividing strips are secured to a discharge side of the forward side and mounted in a semi-circular curve to the corresponding inlet side of the back side. This only depends on the construction of the transport band and its drive, as well as on the coordination of one or two placing devices. The advertising device can be used as an advertising device pulled behind an airplane or mounted on a balloon-type airship or the like.

In one embodiment of the advertising device, the dividing strips are constructed as elastic bands and can be supported by the transport band in such that the transport band has advertising elements directed alternately against one another in every row and are conducted with several dividing strips coordinated with one row.

In another embodiment, the dividing strips can be fixed to and supported by the transport band since all advertising elements are directly oriented in rows and are directed in successively following rows, alternately opposed to one another, whereby the dividing strips each extend over two adjacent rows.

One optimal use of the transport band for formation of the advertising elements is that in every two adjacent rows, the advertising elements are divided against one another in blocks of two or four of every two advertising elements positioned against one another with common dividing strips. Within such rows, the distance elements can be arranged in rows, in a manner practically without intermediary spaces. The same also applies for every two rows which are adjacent to one another.

The transition of placed advertising elements, which are deflected from the plane of the transport band behind the coordinated elastic dividing strip, is accomplished by having dividing strips constructed as flexible bands which have one rigid attachment and guiding profile section on each.

So that the transport band with the elastic dividing strips can be put into the operating position, one embodiment provides that the attachment and guide profile sections of the dividing strip can be fixed in a stationary manner or each fixed on one part of a casing or frame accommodating the transport band and the placing device. The casing can thereby comprise two partial casings which only accommodate the transport rollers, the drive and/or the placing devices, and which can then be secured separately from one another.

In accordance with another embodiment, attachment and guide profile sections are provided with several connection surfaces for differently colored dividing strips, constructed as elastic bands. The attachment and guide profile sections which are supported in a rotatable manner and with a placing device controlled by a data processing device can be rotated at least at the inlet side of the transport band. Preferably, one of the dividing strips can be set in the advertising surface, then multicolor signs, symbols or the like can be shown with the advertising device. In such embodiment, the number of colors is determined by the number of variously colored dividing strips fixed to the attachment and guide profile sections. To keep the row distances small, even with the rotatable attachment and guide profile sections having differently colored dividing strips attached thereto, one embodiment has the width of the attachment and guide profile sections smaller than the width of the dividing strips which are constructed as elastic bands.

If the attachment and guide profile sections have four connection surfaces for dividing strips which are displaced by 90 degrees, then the width of the attachment and guide profile sections is selected so that upon rotation by 45 degrees they do not contact attachment and guide profile sections of adjacent rows. The dividing strips contact other dividing strips of adjacent rows but they are flexible and thus such contact does not cause blocking. By means of deformation, the dividing strips can be placed in the operating position whereby their elasticity is used for support.

If rigid dividing strips are used, then three connection surfaces of the attachment and guide profile sections displaced by 120 degrees are used to avoid contact with the rows adjacent to the dividing strips. This relates to the prism-type advertising devices with three advertising surfaces.

In accordance with another embodiment, the attachment and guide profile sections of the dividing strips, which are turned away from the advertising surface, have support bars positioned in the direction of transport of the transport band and stand perpendicular to the dividing strips. The support bars make a transition into points at least on the inlet side of the transport band to the free end of the attachment and guide profile section. If the edges of the points turned away from the transport band are longer than the edges turned toward the transport band, then through the individual row dividing strips the advertising elements can be securely positioned behind the corresponding dividing strips. Because of the elasticity of the advertising elements they are restored after passing the attachment and guide profile sections, and the advertising elements are placed on the back side of the dividing strip. The same purpose is served by an embodiment in which the attachment and guide profile sections on the inlet side of the transport band converge to the free end and proceed into tips. In every row, some advertising elements are positioned opposing one another to keep the individual row dividing strips on the transport band. This can be accomplished with the data processing device.

The attachment and guide profile sections are fixed by having the support bar, which is turned away from the transport, sealed by means of an attachment plate positioned parallel to the same.

The attachment and guide profile sections can have rotary support bearing with several dividing strips. For every dividing strip arrangement, the attachment plates and attachment guide profile sections, positioned in uniform angular distributions, are combined into a single unit as a rotatably supported bearing support part.

The number of dividing strips per dividing strip arrangement of the advertising surface can be increased. For every dividing strip arrangement on both ends of the advertising surface, equal feeding devices are constructed according to the type of the conveying band, with an equal number of attachment and guide profile sections. Each is coordinated with one dividing strip which can be similarly controlled or activated to bring a selected dividing strip on both ends into active connection with the transport band.

According to one embodiment, a simplified selection of the variously colored images, symbols, or the like, results from having the attachment and guide profile sections of several dividing strip arrangements, which are combined into the bearing support part, commonly controlled and rotated.

BRIEF DESCRIPTION OF THE DRAWINGS

This invention is illustrated in further detail with different embodiments shown in the drawings wherein:

FIG. 10 shows one row of the advertising device in which advertising elements change in color; and FIG. 11 shows a rotary bearing support of a bearing part of a dividing strip arrangement having four attachment and guide profile sections.

DESCRIPTION OF THE PREFERRED EMBODIMENTS

This invention is an improvement to my previous invention as described in U.S. Pat. No. 4,733,487. Many of the general components and basic operations of the matrix-type advertising device of this invention are fully discussed in U.S. Pat. No. 4,733,487, and are incorporated into this invention by reference.

Figure 1:
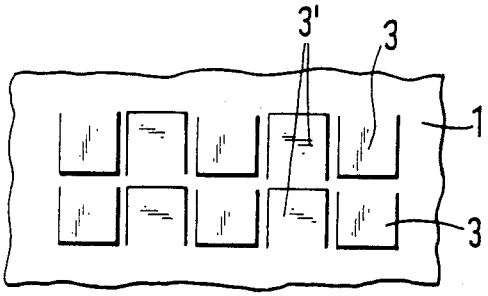
FIG. 1 shows a dividing strip of a transport band having two adjacent rows whereby in every row advertising elements are positioned alternately against one another.

As shown in FIG. 1, on the transport band (1) and in all of its rows, the advertising elements (3 and 3') are so stamped out, etched, or otherwise divided, that they are positioned alternatingly in the direction of the rows, upwardly and downwardly, opposed to one another. The U-shaped dividing lines show that the downwardly directed advertising elements (3) are preferably square-shaped and are only connected with the transport band (1) in the area of their upper edge. The upwardly directed advertising elements (3') are only connected in an articulated manner with the flexible transport band in the area of their upper edge. In this embodiment and arrangement of the advertising elements (3 and 3'), one individual row dividing strip can be coordinated with every row of the advertising field, as will later be described. Both in the area of its upper edge as well as in the area of its lower edge, the advertising field is entirely or partially covered by advertising elements (3 and 3') and can thus be supported by the transport band (1).

Figure 2:
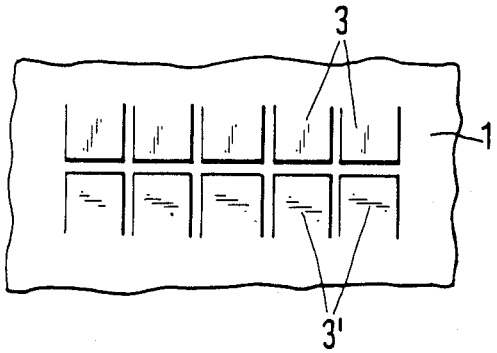
FIG. 2 shows a partial area of a transport band having two adjacent rows, whereby all advertising elements are positioned equally in rows and positioned opposing one another alternately in successively following rows.

As FIG. 2 shows, the advertising elements (3 and 3') can also be constructed in rows such that, in the direction of the aperture or in successively following rows, all advertising elements (3) are directed downwardly and then upwardly in alternating sequence, as the advertising elements (3') of the lower rows show. For a dividing strip to be held and supported by the transport band (1), it is designed to be two rows in width. The upper row with the advertising elements (3) extends over the upper edge of the dividing strip approximately to the center of the same. The advertising elements (3') project over the lower edge of the dividing strip and also extend approximately to the center of the dividing strip. The parts of the transport band (1) forming the intermediate spaces between the advertising elements (3 and 3') lie in front of dividing strips (4), as shown in FIGS. 4 and 5. The deflected advertising elements (3 and 3') are braced by their elasticity, behind the dividing strip, as shown in FIGS. 4 and 5.

In order for the dividing strips (4) to be secured on the transport band (1), for every dividing strip (4), a number of advertising elements (3) directed downwardly are set and a number of advertising elements (3') directed upwardly are set. This can easily be achieved by means of a data processing device.

Figure 3:
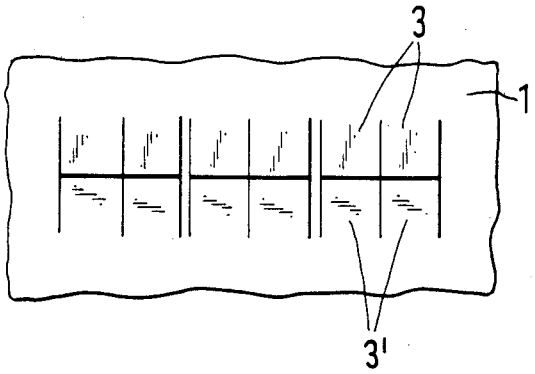
FIG. 3 shows another embodiment of a partial area of a transport band as shown in FIG. 2, whereby in every adjacent row advertising elements are divided against one another in blocks of four or two advertising elements, each positioned against one another with common dividing lines.

FIG. 3 shows the transport band (1) having two adjacent rows formed without intermediate space. The separating lines of the advertising elements (3 and 3') coincide in a block of four advertising elements, two advertising elements (3) and two advertising elements (3') each. The horizontal and vertical narrow strips of the transport band (1) remain standing between the blocks of four advertising elements.

Figure 4A:
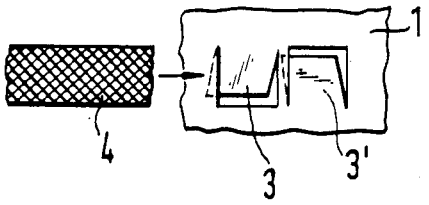
FIGS. 4*a* and 4*b* schematically show the threading of a dividing strip into a row of a transport band, as shown in FIG. 1.
Figure 4B:
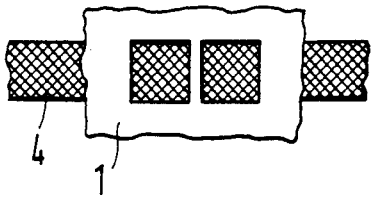

In FIG. 4*a*, the dividing strip (4) is indicated by cross-hatching. The partial area of the transport band (1) shows one advertising element (3) directed downwardly and one advertising element (3') directed upwardly. Both advertising elements are moved outward from the back side of the transport band (1). If the dividing strip (4) is inserted, then both advertising elements (3 and 3') also lie behind the dividing strip (4) so that, as FIG. 4*b* shows, the released sections of the transport band (1) are highlighted by the color of the dividing strip (4). If no advertising element (3 or 3') is placed, then the dividing strip (4), tightened on the ends, is suspended behind the assigned rows. In the case of the placed advertising elements (3 and 3'), the dividing strip (4) is mounted on the transport band (1) and supported by the same. The intermediate spaces between the advertising elements (3 and 3') lie in front of the dividing strip (4) so that it remains mounted on both sides, if all advertising elements (3 and 3') of the row are deflected.

Figure 5A:
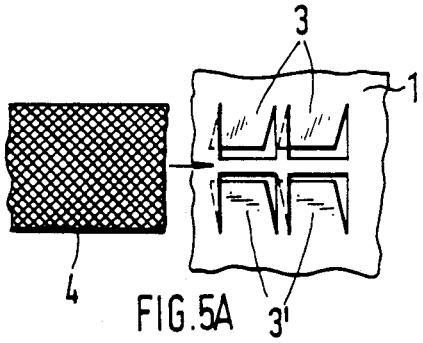
FIGS. 5*a* and 5*b* schematically show the threading of a dividing strip into adjacent rows of a transport band, as shown in FIG. 2.
Figure 5B:
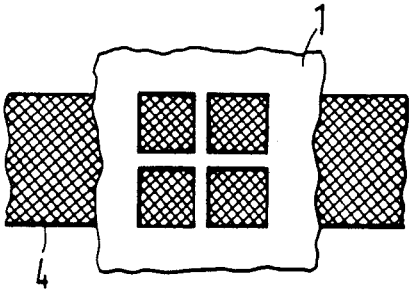

There is a similar process if the dividing strip (4) is coordinated with the two rows adjacent in the direction of the aperture, as shown in FIGS. 5*a* and 5*b*. In the transport band (1), the upper row is continuously provided with advertising elements (3) directed downwardly and the lower row of the pair of rows are continuously provided with advertising elements (3') directed upwardly.

If the dividing strip (4) is pushed inwardly, then the place advertising elements (3 and 3') lie behind the stationary dividing strip (4), while the intermediate areas between the advertising elements (3 and 3') always contact the dividing strip (4) on the front side, even if all the advertising elements (3 and 3') of the pair of rows are deflected. An advertising image is shown in FIG. 5*b* in which all the advertising elements (3 and 3') of the pair of rows are deflected.

Figure 6A:
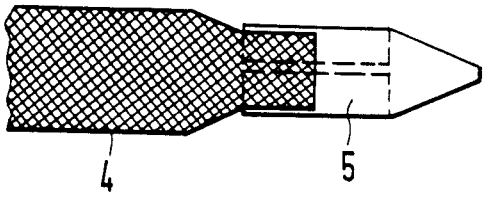
FIG. 6*a* shows an end of an elastic dividing strip with a rigid attachment and guide profile section.

FIG. 6*a* shows the end of a dividing strip (4) which is connected with a rigid attachment and guide profile section (5). The attachment and guide profile section (5) is plate-shaped and has a smaller width than the dividing strip (4) in order to improve insertion of the variously directed advertising elements (3 and 3') of a double row. The attachment and guide profile section (5) is attached to a part (6) by means of a support part. The opposite end of the dividing strip (4) is constructed and fixed in a similar manner. The dividing strips (4) of all rows can be connected and tightened by means of the parts (6). Thus, the parts (6) of both ends can be brought into the operating position of the drive device at the correct distance. The parts (6) can also be parts of a common casing, in which they occupy the correct distance relative to one another. The transport rollers and the drive unit for the transport band (1), as well as the placing device or the placing devices, are positioned in the area of the ends of the dividing strips (4).

Figure 6B:
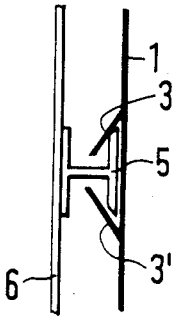
FIG. 6*b* shows a side view of an inlet of placed advertising elements behind an attachment and guide profile section and dividing strip having a transport band with dividing strips, as shown in FIG. 2.

As shown in FIG. 6*b*, the acutely proceeding attachment and guide profile section (5) slides between the deflected or placed advertising elements (3 and 3'). After fitting the attachment and guide profile section (5), the deflected advertising elements (3 and 3') are placed behind the dividing strip (4). In the area of the placed advertising elements (3 and 3'), the dividing strip (4) fills out the released recesses of the transport band (1) and is marked with a color different from that of the transport band (1).

Figure 7A:
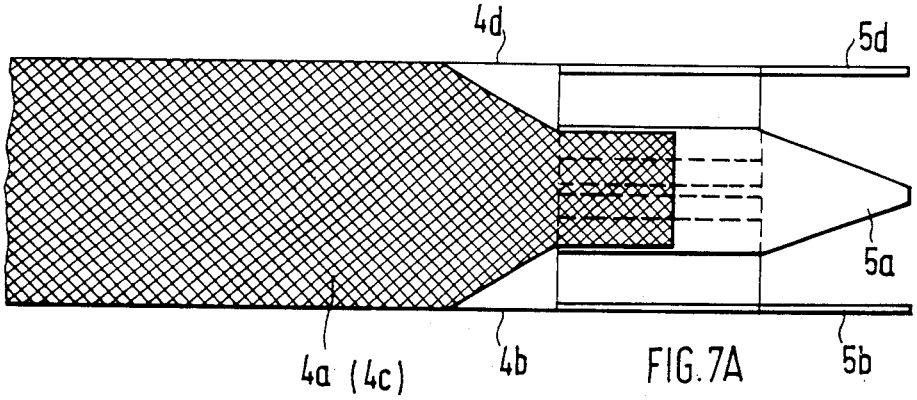
FIG. 7*a* shows a front view of an arrangement of dividing strips having four differently colored dividing strips which are attached to an attachment and guide profile section with four connecting surfaces.
Figure 7B:
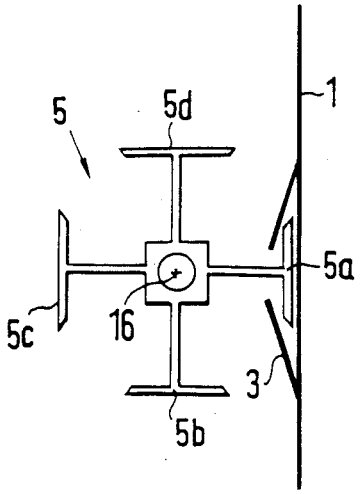
FIG. 7*b* shows a side view of an attachment and guide profile section rotatably positioned with a bearing support part having four connecting surfaces for dividing strips.

As shown in FIGS. 7*a* and 7*b*, the attachment and guide profile section (5) can, in a dividing strip and advertising elements (3, 3') as shown in FIG. 2, have four connecting surfaces (5*a*, 5*b*, 5*c*, 5*d*) to which differently colored dividing strips (4*a*, 4*b*, 4*c*, 4*d*) are attached at their ends. The connection surfaces (5*a* thru 5*d*) are connected, by means of support parts, with a common bearing support part (16) which is supported in a rotatable manner. With the aid of these rotatable bearing support parts (16), the dividing strips (4*a* thru 4*d*) can be brought into a desired operational connection with the transport band (1). Both attachment and guide profile sections (5) of the dividing strip arrangement are supported and can be turned in a rotatable and similar manner.

A change of color with these differently colored dividing strips (4*a* thru 4*d*), which are supported in a rotatable manner, is only possible if the advertisement has first been reset and the dividing strips (4*a* thru 4*d*) are thereby no longer mounted on the transport band (1). A change of color is also possible with continuous moving script, if a certain advertisement gap, which is maintained by means of the data processing device, is provided between the desired colors of one row. The size of the advertising gap thereby depends on the flexibility of the dividing strips (4*a* thru 4*d*). If, for example, in the first half of a moving advertisement, the connecting surface (5*a*) is in the advertising plane, then with very flexible dividing strips (4*a* thru 4*d*), the bearing support parts (16) can be rotated after a horizontal advertising gap. Thus the rest of the moving advertisement, the connecting surfaces (5*b* or 5*c*) come into operational connection with the transport band (1). Between the first and second part of the advertisement, the dividing strips (4*a* thru 4*d*) are only rotated by 90 degrees which is possible since they are very flexible.

The bearing support parts (16) can be individually controlled by means of individual row placing devices by the data processing device. A common placing device for the bearing support parts (16) of several or all rows can also be provided.

Figure 8:
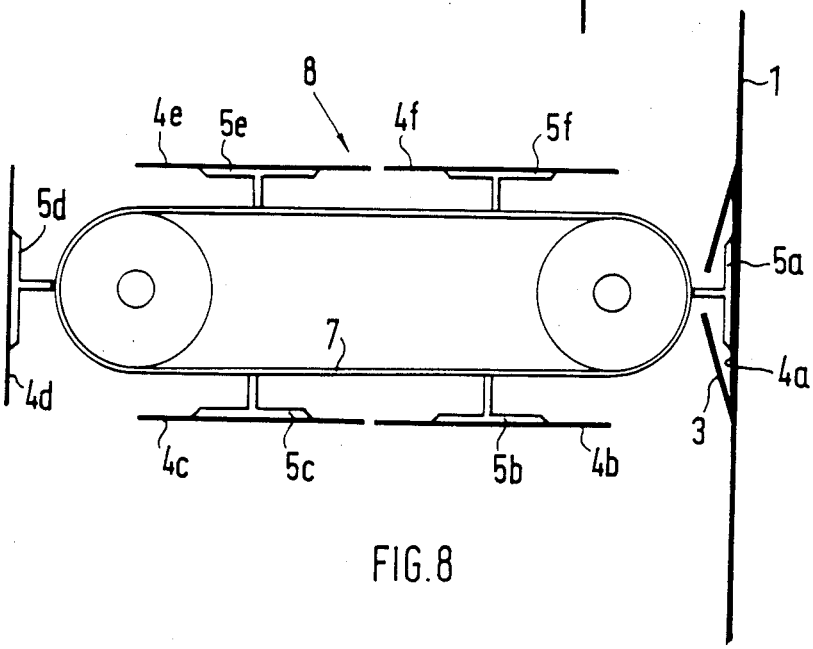
FIG. 8 shows a side view of a feed device having one of six attachment and guide profile sections with differently colored strips in a desired operational position with a transport band.

As shown in FIG. 8, in a dividing strip and advertising element according to FIG. 2, a feeding device (8) constructed in accordance with the type of a conveying band can also be coordinated with every row. For example, six connecting surfaces (5*a* thru 5*f*) with differently colored dividing strips (4*a* thru 4*f*) can be brought into operating connection with the transport band (1), as desired. This same feed device (8) is provided on both ends of the dividing strips (4*a* thru 4*f*).

Figure 9B:
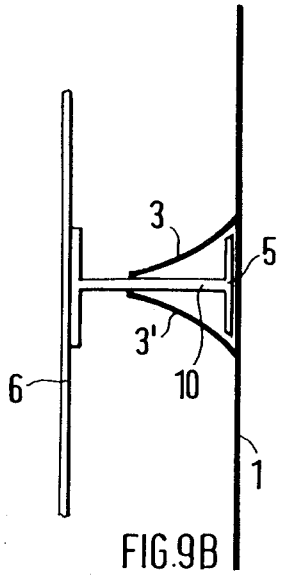
FIG. 9*b* shows a side view of an attachment and guide profile section in operational connection with an advertising element of a transport band positioned against one another, as shown in FIG. 1.
Figure 9A:
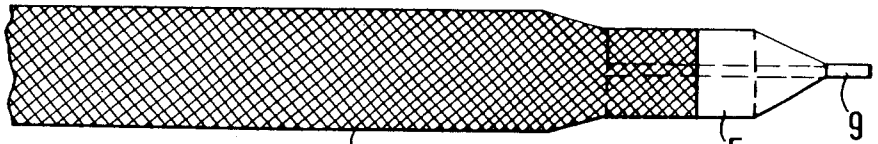
FIG. 9*a* shows a front view of an individual row dividing strip having a rigid attachment and guide profile section provided with the support bar.
Figure 9C:
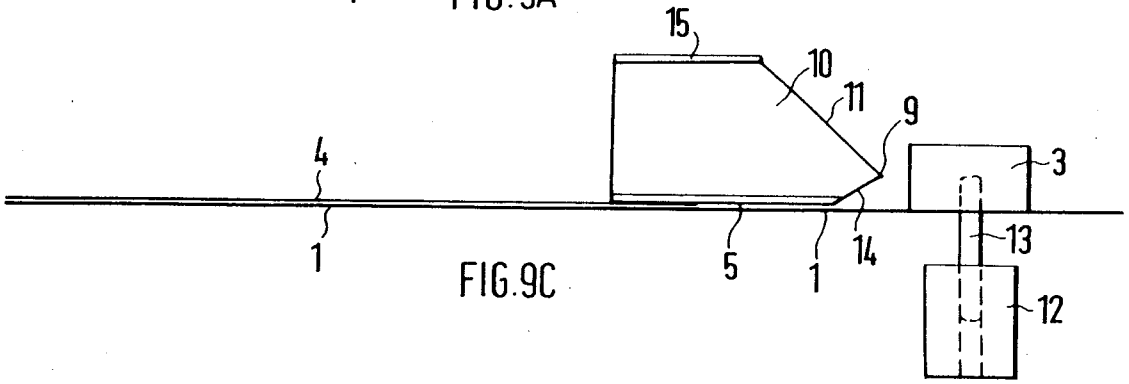
FIG. 9*c* shows a top view of dividing strips having an attachment and guide profile section, a transport band and a placing device moved forward.

In FIGS. 9*a* thru 9*c*, the attachment and guide profile section (5) is constructed with individual row dividing strips (4) and advertising elements (3, 3') in accordance with FIG. 1. As FIG. 9*a* shows, the attachment and guide profile section (5) is smaller in width than the width of the attached dividing strip (4). Furthermore, the attachment and guide profile section (5) proceeds to the free end in a pointed shape. The support bar (10) is integrally formed with the back side of the attachment and guide profile section (5). The bar at the free end forms a pointed tip (9) which forms an acute angle. The edge (14) oriented toward the transport band (1) is thereby shorter than the edge (11) turned away from the transport band (1). Thus, the advertising elements (3) placed shortly before the inlet into the attachment and guide profile section (5) are safely conducted behind the dividing strip (4). The placing device (12) can have placing bolts (13) which may be activated magnetically, and deflect the advertising elements (3 and 3') to the back side of the transport band (1). The support bar (10) makes a transition into the attachment plate (15) which proceeds parallel to the attachment and guide profile section (5) and is attached to the part (6).

The advertising element (3 or 3'), deflected from the placing bolts (13), is grasped at the pointed tip (9) of the attachment and guide profile section (5), and is strongly bent through at the edge (11), as shown in FIG. 9*b*. If the placed advertising element (3 or 3') leaves the attachment and guide profile section (5), then the placed advertising elements (3 or 3'), because of their own elasticity, snap back vigorously. If they first arrive at the opposite end of the dividing strip (4), they are again bent back by an oblique edge. The attachment and guide profile section (5) on the opposite or discharge end of the transport band (1) requires no pointed tip (9). The edge proceeds up to the front surface of the attachment and guide profile section (5).

Transport bands (1) in accordance with FIG. 2 are inclined so that the intermediate spaces between the rows are "paired". This is not the case with the transport bands (1) in accordance with FIG. 1. By the word "paired", it is understood that the intermediate spaces from row to row are alternately larger and smaller, in a manner known from television screens with poor line-interlacing. Thus, in the transport bands (1) in accordance with FIG. 2, the advertisinq elements (3, 3') are not so greatly bent out upon deflecting. The transport bands (1) in accordance with FIG. 1 thus require more durable material which is capable of being roughly treated.

In FIG. 10, the color change within one row is shown. The four dividing strips (4*a* thru 4*d*) are connected on both ends with bearing support parts (16 and 16'), with which the dividing strips (4*a* thru 4*d*), through rotation can be brought into operational connection with the transport band (1). Every bearing support part (16 and 16') has four connection surfaces (5*a* thru 5*d*). As the different cross-hatching of the dividing strips (4*a* and 4*b*) shows, the dividing strips have different colors, for example, red and blue.

At the beginning of the advertisement, the red dividing strip (4*a*) is in operational connection with the transport band (1) so that the fields of the placed advertising appear red, as is shown in the left-hand part of FIG. 10. In a further and continuing advertisement, after stopping the sign gap (20) on the inlet side, the bearing support part (16) is rotated by 90 degrees so that the blue dividing strip (4*b*) attached to the connection surface (5*b*) comes into operational connection with the transport band (1). The placed advertising elements now appear blue, as the right-hand part of FIG. 10 shows. The bearing support part (16') can thereby be freely supported in a rotatable manner, so that, after discharge of the dividing strip (4*a*) out of the transport band (1), this independently rotates by 90 degrees. It may also be rotated in a correspondingly delayed manner by means of the data processing device and a placing device.

In the same manner, instead of the blue dividing strip (4*b*), through opposed rotation of the bearing support part (16) by 90 degrees the dividing strip can be brought into operational connection with the transport band (1). This further dividing strip could be yellow, for example.

FIG. 11 shows how the rotation of the bearing support (16) can be constructed. The bearing support part (16) with the four connection surfaces (5*a* thru 5*d*) is attached in a non-rotatable manner on the bearing support bolt (19), as with the attachment nut (17). By means of the geared motor (18), the bearing support bolt (19) is rotated at a 90 degree rotational angle. The control takes place by means of the data processing device, which is attached, for example, by means of the distribution voltage of the geared motor (18), by the angle bracket (21) to the part (6) of the housing or frame. Both ends of a dividing strip can be supported in the same manner over the distance of the bearing support parts (16 and 16'), the dividing strips (4) can be tightened. As FIG. 10 shows, at the discharge side of the transport band (1) the connection surfaces (5*a* thru 5*d*) have no tips, as on the inlet side on the bearing support part (16).

Instead of the individual row or individual pair row geared motors (18), only one central geared motor need be controlled. The geared motor commonly rotates the bearing support parts (16 or 16') of all rows or pairs of rows. The bearing support parts (16 or 16') correspondingly assigned to the rows or pairs of rows are, by means of corresponding coupling devices, so connected with one another that the same colored dividing strips (4) are always in operational connection with the transport band (1).

I claim:

1. In a matrix-type advertising device with a circulating transport unit having flap-like advertising elements positioned in rows and columns connected with a transport band on one side, proceeding in a direction of transport, further having dividing strips positioned in an advertising area, the dividing strips coordinated with individual rows having a color contrasting with a transport band of the advertising elements, the advertising elements in front of or behind the assigned dividing strips capable of being brought into an advertising position, the improvement comprising;

said dividing strips (4) constructed as flexible bands, said flap-like advertising elements (3, 3') positioned against one another whereby edges of a flexible said dividing strip (4) proceeding in a direction of transport are conducted within and supported by said transport band (1).

2. In a matrix-type advertising device in accordance with claim 1, wherein said transport band (1) having in every row alternating advertising elements (3, 3') positioned against one another is conducted with said dividing strips (4) each positioned in one row.

3. In a matrix-type advertising device in accordance with claim 1, wherein said advertising elements (3, 3') are positioned equally in rows and are positioned alternatingly opposed to one another in successively following rows, whereby said dividing strips (4) each extend over two adjacent rows.

4. In a matrix-type advertising device in accordance with claim 3, wherein in every said two adjacent rows said advertising elements (3 and 3') are divided against one another in blocks of at least one of two and four of said advertising elements (3 and 3') positioned against one another and having common separating lines.

5. In a matrix-type advertising device in accordance with claim 4, wherein said dividing strips (4) constructed as flexible bands are provided on each of both ends with one rigid said attachment and guide profile section (5).

6. In a matrix-type advertising device in accordance with claim 5, wherein said attachment and guide profile sections (5) of said dividing strips (4) are fixed to one part (6) of a frame accommodating said transport band (1) and a placing device (12).

7. In a matrix-type advertising device in accordance with claim 5, wherein said attachment and guide profile sections (5) of said dividing strips (4) are stationary.

8. In a matrix-type advertising device in accordance with claim 5, wherein said attachment and guide profile sections (5) have connection surfaces (5*a*, 5*b*, 5*c*, 5*d*) for differently colored dividing strips (4*a*, 4*b*, 4*c*, 4*d*) constructed as elastic bands; and said attachment and guide profile sections (5) are supported in a rotatable manner and rotatable with a placing device controlled by a data processing device, on at least an inlet side of said transport band (1), whereby one of said dividing strips (4*a*, 4*b*, 4*c*, 4*d*) can be selectively inserted into an advertising surface.

9. In a matrix-type advertising device in accordance with claim 8, wherein a first width of said attachment and guide profile sections (5) is smaller than a second width of said dividing strips (4, 4*a*, 4*b*, 4*c*, 4*d*) constructed as elastic bands.

10. In a matrix-type advertising device in accordance with claim 9, wherein said attachment and guide profile sections (5) of said dividing strips (4, 4*a*, 4*b*, 4*c*, 4*d*) of an advertising surface have dividing bars (10) positioned away from a direction of transport of said transport band (1) and perpendicular to said dividing strips (4, 4*a*, 4*b*, 4*c*, 4*d*), and each of said dividing bars (10) make a transition at least on an inlet side of said transport band (1) into a pointed tip (9) to a free end of said attachment and guide profile sections (5).

11. In a matrix-type advertising device in accordance with claim 10, wherein said pointed tips (9) of said support bars (10) form acute angles, whereby first edges (11) of said pointed tips (9) turned away from said transport band (1) are longer than the second edges (14) turned toward said transport band (1).

12. In a matrix-type advertising device in accordance with claim 11, wherein each said support bar (10) turned away from said transport band (1) is sealed with an attachment plate (15) positioned parallel to said transport band (1).

13. In a matrix-type advertising device in accordance with claim 12, wherein for arrangement of each of said dividing strips, said attachment plates (15) and connecting surfaces of said attachment and guide profile sections (5*a*, 5*b*, 5*c*, 5*d*) positioned in uniform angular distribution are combined in a single unit to a rotatably supported bearing support part (16).

14. In a matrix-type advertising device in accordance with claim 13, wherein at least on said inlet side of said transport band (1) said attachment and guide profile sections (5) converge toward said free end.

15. In a matrix-type advertising device in accordance with claim 14, wherein for each said dividing strip arrangement, on both ends of said advertising surface, feed devices (8) with an equal number of said attachment and guide profile sections (5) constructed as a conveyor belt, with said connecting surfaces (5*a* thru 5*f*) each having one of said dividing strips (4*a* thru 4*f*) coordinated which is similarly controlled and activated to bring a selected said dividing strip (4*a*) into operational connection with said transport band (1).

16. In a matrix-type advertising device in accordance with claim 13, wherein said attachment and guide profile sections (5) combined to said bearing support part (16) is commonly controlled and rotated with said connection surfaces (5*a*, 5*b*, 5*c*, 5*d*) of arrangements of said dividing strips (4*a*, 4*b*, 4*c*, 4*d*).

17. In a matrix-type advertising device in accordance with claim 1, wherein said dividing strips (4) constructed as flexible bands are provided on each of both ends with one rigid said attachment and guide profile section (5).

18. In a matrix-type advertising device in accordance with claim 5, wherein a first width of said attachment and guide profile sections (5) is smaller than a second width of said dividing strips (4, 4*a*, 4*b*, 4*c*, 4*d*) constructed as elastic bands.

19. In a matrix-type advertising device in accordance with claim 5, wherein said attachment and guide profile sections (5) of said dividing strips (4, 4*a*, 4*b*, 4*c*, 4*d*) of an advertising surface have dividing bars (10) positioned away from a direction of transport of said transport band (1) and perpendicular to said dividing strips (4, 4*a*, 4*b*, 4*c*, 4*d*), and each of said dividing bars (10) make a transition at least on an inlet side of said transport band (1) into a pointed tip (9) to a free end of said attachment and guide profile sections (5).

20. In a matrix-type advertising device in accordance with claim 10, wherein each said support bar (10) turned away from said transport band (1) is sealed with an attachment plate (15) positioned parallel to said transport band (1).

21. In a matrix-type advertising device in accordance with claim 5, wherein at least on said inlet side of said transport band (1) said attachment and guide profile sections (5) converge toward said free end.

22. In a matrix-type advertising device in accordance with claim 1, wherein for each said dividing strip arrangement, on both ends of said advertising surface, feed devices (8) with an equal number of said attachment and guide profile sections (5) constructed as a conveyor belt, with said connecting surfaces (5*a* thru 5*f*) each having one of said dividing strips (4*a* thru 4*f*) coordinated which is similarly controlled and activated to bring a selected said dividing strip (4*a*) into operational connection with said transport band (1).

* * * * *